US012061044B2

(12) United States Patent
Hirai et al.

(10) Patent No.: US 12,061,044 B2
(45) Date of Patent: Aug. 13, 2024

(54) NATURAL GAS LIQUEFYING APPARATUS

(71) Applicant: JGC CORPORATION, Kanagawa (JP)

(72) Inventors: Akito Hirai, Kanagawa (JP); Nobuhiro Kimura, Kanagawa (JP); Hideto Hagiya, Kanagawa (JP); Shinichi Tojo, Kanagawa (JP); Junichi Nishida, Kanagawa (JP); Tomoaki Matsuo, Kanagawa (JP); Ayaka Uemura, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 242 days.

(21) Appl. No.: 17/639,570

(22) PCT Filed: Oct. 9, 2019

(86) PCT No.: PCT/JP2019/039815
§ 371 (c)(1),
(2) Date: Mar. 1, 2022

(87) PCT Pub. No.: WO2021/070282
PCT Pub. Date: Apr. 15, 2021

(65) Prior Publication Data
US 2022/0290917 A1 Sep. 15, 2022

(51) Int. Cl.
*F25J 1/00* (2006.01)
*F25J 1/02* (2006.01)

(52) U.S. Cl.
CPC ..... *F25J 1/0022* (2013.01); *F25J 1/0052* (2013.01); *F25J 1/0259* (2013.01); *F25J 1/0283* (2013.01);
(Continued)

(58) Field of Classification Search
CPC ..... F25J 1/0257; F25J 1/0267; F25J 1/0258; F25J 1/0052; F25J 1/0022; F25J 1/0283; F25J 1/0292; F25J 1/0294; F25J 2290/42
See application file for complete search history.

(56) References Cited

U.S. PATENT DOCUMENTS

2006/0150671 A1* 7/2006 Lijima ..... F25J 1/0259 62/612
2014/0053599 A1 2/2014 Byfield
(Continued)

FOREIGN PATENT DOCUMENTS

JP 2007506064 3/2007
JP 4912564 4/2012
(Continued)

OTHER PUBLICATIONS

"International Search Report (Form PCT/ISA/210) of PCT/JP2019/039815", mailed on Dec. 17, 2019, with English translation thereof, pp. 1-4.

*Primary Examiner* — Brian M King
(74) *Attorney, Agent, or Firm* — JCIPRNET

(57) ABSTRACT

A natural gas liquefying apparatus is provided. At least a part of a cooling region, in which a precooling unit and a liquefaction unit are arranged, and at least a part of a compression region, in which first and second compressors compressing refrigerants to be used in the precooling unit and the liquefaction unit are arranged, are arranged to be opposed to each other across a long side of a second refrigerant cooler group arrangement region in which a liquefying refrigerant is cooled. A first refrigerant cooler group arrangement region, in which a precooling refrigerant is cooled, is arranged so that a long side of the first refrigerant cooler group arrangement region is opposed to one side of a rectangular region including the compression region, the one side being different from a side of the rectangular region opposed to a long side of the second refrigerant cooler group arrangement region.

6 Claims, 7 Drawing Sheets

(52) U.S. Cl.
CPC ..... *F25J 1/0292* (2013.01); *F25J 1/0294* (2013.01); *F25J 1/0296* (2013.01); *F25J 2210/60* (2013.01)

(56) References Cited

U.S. PATENT DOCUMENTS

| | | | | |
|---|---|---|---|---|
| 2017/0097188 | A1* | 4/2017 | Lupascu | F25J 1/0082 |
| 2017/0097189 | A1* | 4/2017 | Guy | F25J 1/0022 |
| 2019/0055887 | A1* | 2/2019 | Giancotti | F25J 1/0022 |

FOREIGN PATENT DOCUMENTS

| | | |
|---|---|---|
| JP | 2018150930 | 9/2018 |
| JP | 2018185102 | 11/2018 |
| WO | 2018235267 | 12/2018 |

* cited by examiner

NATURAL GAS LIQUEFYING APPARATUS

CROSS-REFERENCE TO RELATED APPLICATION

This application is a 371 application of the International PCT application serial no. PCT/JP2019/039815, filed on Oct. 9, 2019. The entirety of the above-mentioned patent application is hereby incorporated by reference herein and made a part of this specification.

TECHNICAL FIELD

The present invention relates to a natural gas liquefying apparatus configured to liquefy natural gas by cooling the natural gas through use of a refrigerant.

RELATED ART

A natural gas liquefying apparatus (NG liquefying apparatus) is configured to liquefy natural gas (NG) produced from, for example, a gas well by cooling the natural gas, to thereby produce liquefied natural gas (LNG).

As described in, for example, Patent Document 1, the NG liquefying apparatus includes devices such as a precooling heat exchanger for precooling the natural gas, and a cryogenic heat exchanger for liquefying the natural gas. The NG is allowed to flow through the devices via pipes connected between the devices, and is sequentially subjected to treatments. Further, the precooling heat exchanger and the cryogenic heat exchanger are each configured to cool the NG through heat exchange using a refrigerant, and are configured to allow the refrigerants to flow through the devices via pipes provided between the heat exchangers and compressors for compressing the refrigerants used for heat exchange. For the NG liquefying apparatus including a large number of devices in addition to the above-mentioned devices, there is a demand to pursue device arrangement capable of achieving easiness of construction, and reducing amounts of materials such as pipe forming members to be used as much as possible.

RELATED ART DOCUMENTS

Patent Documents

Patent Document 1: Japanese Patent No. 4912564

SUMMARY OF THE INVENTION

Problem to Be Solved

The present invention has been made in view of such circumstances, and has an object to provide a natural gas liquefying apparatus constructed with excellent constructability and reduced in amounts of materials to be used.

Means for Solving Problem

According to the present invention, there is provided a natural gas liquefying apparatus for liquefying natural gas, including:

a cooling region in which a precooling unit and a liquefaction unit are arranged, the precooling unit including a precooling heat exchanger configured to precool, through use of a precooling refrigerant, the natural gas supplied to the natural gas liquefying apparatus, the liquefaction unit including a heat exchanger for liquefaction configured to liquefy the precooled natural gas through use of a liquefying refrigerant;

a compression region in which a first compressor and a second compressor are arranged, the first compressor being configured to compress the vaporized precooling refrigerant, the second compressor being configured to compress the vaporized liquefying refrigerant;

a first refrigerant cooler group arrangement region in which an air-cooled cooler group configured to cool the precooling refrigerant compressed by the first compressor is arrayed and arranged so as to have a rectangular shape in top view; and a second refrigerant cooler group arrangement region in which an air-cooled cooler group configured to cool the liquefying refrigerant compressed by the second compressor is arrayed and arranged so as to have a rectangular shape in top view, wherein at least a part of the cooling region and at least a part of the compression region are arranged so as to be opposed to each other across a long side of the rectangular shape of the second refrigerant cooler group arrangement region, and wherein the first refrigerant cooler group arrangement region is arranged so that a long side of the first refrigerant cooler group arrangement region is opposed to one side of a rectangular region including the compression region, the one side being different from a side of the rectangular region opposed to a long side of the second refrigerant cooler group arrangement region.

The natural gas liquefying apparatus may have the following characteristics.

(a) The first refrigerant cooler group arrangement region and the second refrigerant cooler group arrangement region are arranged so as to be opposed to each other across the rectangular region.

(b) The first refrigerant cooler group arrangement region and the second refrigerant cooler group arrangement region are arranged so that a long side of the first refrigerant cooler group arrangement region and a long side of the second refrigerant cooler group arrangement region are respectively opposed to two sides of the rectangular region that sandwich a same one corner of the rectangular region.

(c) A subcooling unit and a third compressor are arranged, the subcooling unit including a subcooling heat exchanger configured to subcool the liquefied natural gas through use of a subcooling refrigerant, the third compressor being configured to compress the subcooling refrigerant vaporized by the subcooling heat exchanger.

(d) The first refrigerant cooler group arrangement region is divided into two refrigerant cooler group arrangement regions arrayed and arranged so as to have rectangular shapes in top view, and long sides of the two refrigerant cooler group arrangement regions are oriented in a same direction, and the two refrigerant cooler group arrangement regions are arranged adjacent to each other in a direction of a short side of the two refrigerant cooler group arrangement regions.

(e) The first compressor and the second compressor are configured to be driven by a shared driver.

Effect of Invention

According to the present invention, at least a part of the cooling region, in which the precooling unit including the precooling heat exchanger and the liquefaction unit including the heat exchanger for liquefaction are arranged, and at least a part of the compression region, in which the first and second compressors configured to compress the refrigerants to be used in the precooling unit and the liquefaction unit are arranged, are arranged so as to be opposed to each other across the long side of the second refrigerant cooler group arrangement region in which the liquefying refrigerant is cooled. With this configuration, the pipes connecting the precooling unit and the first compressor and connect the liquefaction unit and the second compressor to each other can be reduced in length, and hence amounts of pipe materials to be used can be reduced.

Further, the first refrigerant cooler group arrangement region, in which the precooling refrigerant is cooled, is arranged so that the long side of the first refrigerant cooler group arrangement region is opposed to one side of the rectangular region including the compression region, the one side being different from the side of the rectangular region opposed to the long side of the second refrigerant cooler group arrangement region. When the first refrigerant cooler group arrangement region and the second refrigerant cooler group arrangement region are thus arranged apart from each other, construction work using, for example, a crane is easily performed, and excellent constructability is achieved.

DESCRIPTION OF THE EMBODIMENTS

Figure 1:
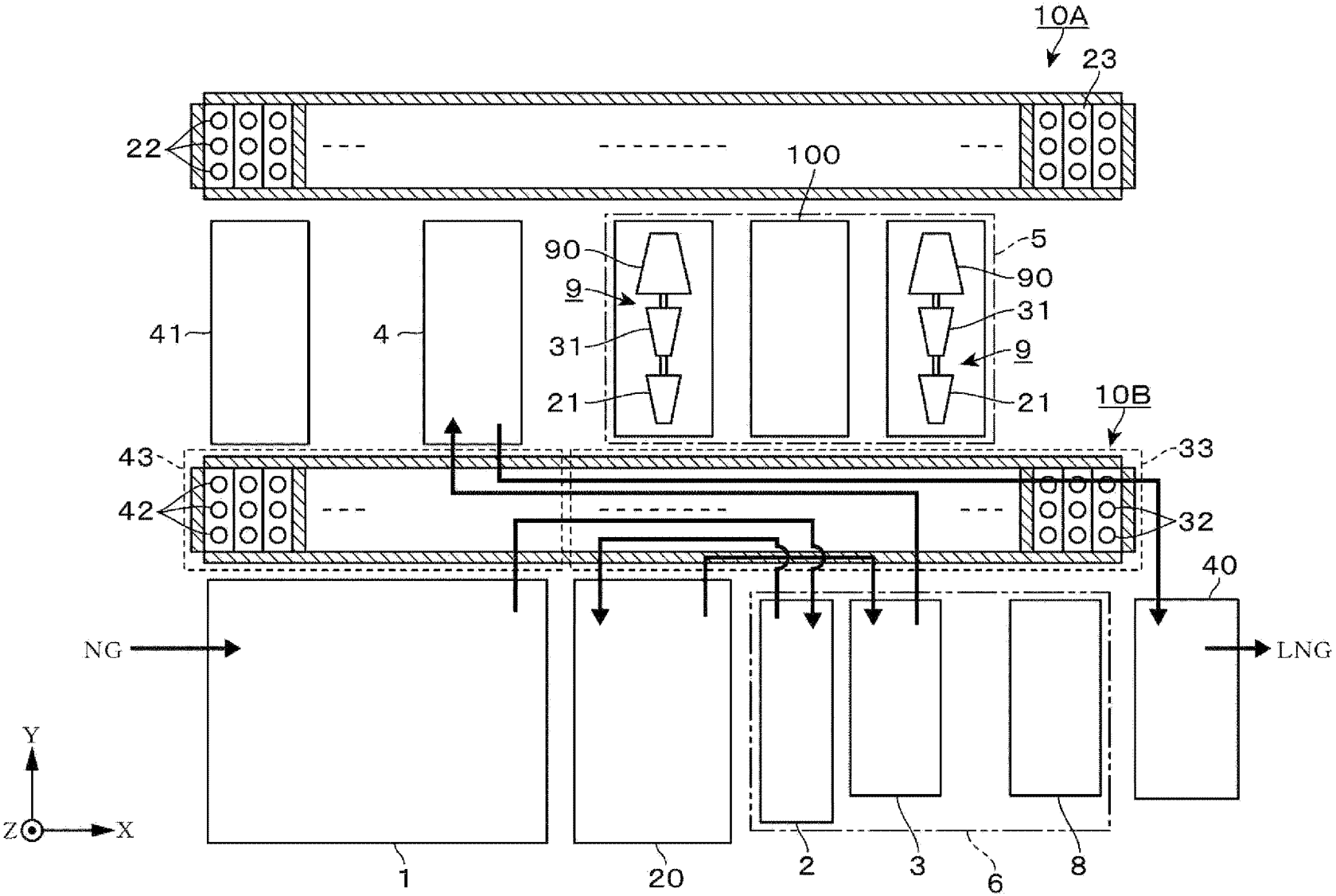
FIG. 1 is a plan view for illustrating an overall configuration of an NG liquefying apparatus according to an embodiment of the present invention.

A natural gas (NG) liquefying apparatus according to this embodiment is described with reference to FIG. 1. The NG liquefying apparatus includes a hot section 1 configured to perform a pretreatment, specifically, removal of various kinds of impurities such as mercury, acid gases (for example, hydrogen sulfide, mercaptan, and carbon dioxide), water, and heavy components that are included in an NG produced from a wellhead. The NG liquefying apparatus further includes a precooling unit 2, a heavy-component removing unit 20, and a liquefaction unit 3. The precooling unit 2 is configured to precool the NG, which has been subjected to the pretreatment, to about −35° C. The heavy-component removing unit 20 is configured to separate liquefied heavy components from the precooled NG. The liquefaction unit 3 is configured to liquefy the NG, from which the heavy components are removed, by cooling the NG to a range of from −100° C. to −120° C. The NG liquefying apparatus according to this embodiment further includes a subcooling unit 4 and an end flash unit 40. The subcooling unit 4 is configured to subcool the LNG subjected to liquefaction to a range of from −150° C. to −156° C. The end flash unit 40 is configured to adiabatically expand part of the subcooled LNG and decrease a temperature of the LNG to a range of from about −159° C. to about −162° C., thereby obtaining a liquid LNG under the normal pressure.

The units forming the NG liquefying apparatus (specifically, the hot section 1, the precooling unit 2, the heavy-component removing unit 20, the liquefaction unit 3, the subcooling unit 4, and the end flash unit 40) include a large number of devices (device groups) including, for example, static devices such as column towers, tanks, and heat exchangers, dynamic devices such as pumps, and connection pipes connecting the static devices and the dynamic devices to each other. The device groups are collected in the units, respectively, and are arranged in a multi-story framework having a framed structure. Among line frames illustrated in FIG. 1 to FIG. 7, line frames, which are denoted by the reference symbols 1, 2, 3, 4, 20, and 40 corresponding to the respective units, indicate arrangement regions for the device groups that form the devices of the units.

The precooling unit 2 includes a heat exchanger (precooling heat exchanger) configured to precool the NG through use of a precooling refrigerant. Further, the NG liquefying apparatus includes first compressors 21 and a first refrigerant cooler group 22. The first compressors 21 are configured to compress the precooling refrigerant vaporized by the precooling unit. The first refrigerant cooler group 22 includes a plurality of air-cooled coolers (ACHEs) configured to cool the compressed precooling refrigerant.

Similarly, the liquefaction unit 3 includes a heat exchanger (heat exchanger for liquefaction) configured to liquefy the NG through use of a liquefying refrigerant, and the subcooling unit 4 includes a heat exchanger (subcooling heat exchanger) configured to subcool the LNG through use of a subcooling refrigerant. The NG liquefying apparatus further includes second compressors 31, a second refrigerant cooler group 32, a third compressor 41, and a third refrigerant cooler group 42. The second compressors 31 are configured to compress the vaporized liquefying refrigerant. The second refrigerant cooler group 32 includes a plurality of ACHEs configured to cool the compressed liquefying refrigerant. The third compressor 41 is configured to compress the vaporized subcooling refrigerant. The third refrigerant cooler group 42 includes a plurality of ACHEs configured to cool the compressed subcooling refrigerant.

In this embodiment, the first compressor 21 and the second compressor 31 form a gas turbine compressor 9 to be driven by a shared driver (gas turbine) 90, and two gas turbine compressors 9 are provided. Only one gas turbine compressor 9 may be provided, and the first compressor 21 and the second compressor 31 may be driven by separate drivers, respectively.

Further, the NG liquefying apparatus according to this embodiment includes a liquefying-refrigerant/precooling-refrigerant heat exchanger 8 (hereinafter, also referred to as "heat exchanger for refrigerant cooling 8") configured to further cool, through use of the above-mentioned precooling refrigerant, the liquefying refrigerant cooled by the second refrigerant cooler group 32.

As described above, the NG liquefying apparatus according to this embodiment is configured to produce the LNG through use of three kinds of refrigerants. As examples of the refrigerants, there can be given a case in which propane is used as the precooling refrigerant, a mixed refrigerant (MR) obtained by mixing, for example, nitrogen, methane, ethane, and propane is used as the liquefying refrigerant, and nitrogen is used as the subcooling refrigerant. Further, as an example of another combination of refrigerants, there can be given a case in which propane is used as the precooling refrigerant, ethylene is used as the liquefying refrigerant, and methane is used as the subcooling refrigerant.

Further, the NG liquefying apparatus includes a first pipe rack 10A and a second pipe rack 10B. The first pipe rack 10A and the second pipe rack 10B are each formed of a framework having a rectangular shape in top view, and each have a plurality of stories, for example, a three-story structure. On the stories of the first pipe rack 10A and the second pipe rack 10B, there are provided pipes through which the NG is transferred among the units configured to treat the NG, and pipes (not shown) through which the refrigerants are allowed to flow among the heat exchangers, the compressors 21, 31, and 41, and the refrigerant cooler groups 22, 32, and 42.

Further, an upper surface of the first pipe rack 10A and an upper surface of the second pipe rack 10B form refrigerant cooler group arrangement regions 23, 33, and 43 in which the first to third refrigerant cooler groups 22, 32, and 42 are arrayed and arranged so as to have rectangular shapes in top view. In a case of the NG liquefying apparatus according to this embodiment, the upper surface of the first pipe rack 10A forms the first refrigerant cooler group arrangement region 23, and a right region and a left region in a direction of a long side of the second pipe rack 10B of FIG. 1 form the second refrigerant cooler group arrangement region 33 and the third refrigerant cooler group arrangement region 43, respectively.

Among rectangular line frames illustrated in FIG. 1, FIG. 2, and FIG. 4 to FIG. 7, line frames, which are denoted by the reference symbols 10A and 10B corresponding to the pipe racks, indicate arrangement regions for the frameworks that form the first pipe rack 10A and the second pipe rack 10B. Further, in FIG. 1, FIG. 2, FIG. 5, and FIG. 6, dotted line frames superposed on the second pipe rack 10B indicate the second refrigerant cooler group arrangement region 33 and the third refrigerant cooler group arrangement region 43. Moreover, in FIG. 1, FIG. 2, and FIG. 4 to FIG. 7, circles illustrated in the line frames indicating the pipe racks 10A and 10B schematically indicate a part of the ACHEs. In FIG. 1, FIG. 2, and FIG. 4 to FIG. 7, in order to avoid complicated illustrations in the drawings, the ACHEs are illustrated in only a partial region of each of the pipe racks 10A and 10B.

The ACHEs included in the refrigerant cooler groups 22, 32, and 42 descried above are configured to take in the air through use of a rotary fan from air inlet ports formed on lower sides of the ACHEs (lower sides of the upper surfaces of the pipe racks), and discharge the air through air outlet ports formed so as to extend upward (not shown). The cooling air is supplied to a tube bundle obtained by bundling tubes through which a fluid to be cooled (refrigerant) flows, thereby being capable of cooling the fluid to be cooled (refrigerant) supplied into the refrigerant cooler groups.

The NG liquefying apparatus includes, in addition to the devices described above, utility device groups including, for example, a power generation turbine or a power generator, a power source for the turbine, and a boiler configured to generate steam being a heat source for a fractionator provided in the heavy-component removing unit 20 or a heating system configured to heat a heat medium such as hot water or hot oil. In FIG. 1, FIG. 2, and FIG. 4 to FIG. 6, illustrations of the utility device groups are omitted.

Arrangement of the units of the NG liquefying apparatus according to this embodiment is described. As illustrated in FIG. 1, at substantially a center of the NG liquefying apparatus, the second pipe rack 10B is arranged. Along one long side of the second pipe rack 10B, from one end side to another end side of the second pipe rack 10B, the hot section 1, the heavy-component removing unit 20, the precooling unit 2, the liquefaction unit 3, the heat exchanger for refrigerant cooling 8, and the end flash unit 40 are provided in the stated order. Further, along another long side of the second pipe rack 10B, from the one end side to the another end side of the second pipe rack 10B, the third compressor 41, the subcooling unit 4, and the two gas turbine compressors 9 are provided in the stated order. An auxiliary pipe rack 100 is provided between the two gas turbine compressors 9.

Herein, a region in which the two gas turbine compressors 9 are provided is referred to as a compression region 5, and a region in which the precooling unit 2, the liquefaction unit 3, and the heat exchanger for refrigerant cooling 8 are provided is referred to as a cooling region 6. In this case, at least a part of the compression region 5 and at least a part of the cooling region 6 are provided so as to be opposed to each other across the long side of the second pipe rack 10B.

When a focus is made on a rectangular region including the compression region 5 (in FIG. 1, a region enclosed by the dot-dash line corresponding to the compression region 5), the first pipe rack 10A is arranged so that a long side of the first pipe rack 10A is opposed to one side of the rectangular region, the one side being opposite to a side of the rectangular region opposed to a long side of the second pipe rack 10B. In other words, the first pipe rack 10A (first refrigerant cooler group arrangement region 23) and the second pipe rack 10B (second refrigerant cooler group arrangement region 33) are arranged so as to be opposed to each other across the rectangular region described above.

In FIG. 1, regarding the NG liquefying apparatus in which the units are arranged as described above, a schematic flow of a fluid to be processed (NG or LNG subjected to liquefaction) is indicated by the solid arrows. For example, the NG produced from a wellhead is treated while flowing through the hot section (pretreatment section) 1, the precooling unit 2, the heavy-component removing unit 20, the liquefaction unit 3, the subcooling unit 4, and the end flash unit 40 in the stated order through the second pipe rack 10B, and then flows out of the NG liquefying apparatus as the LNG.

Figure 2:
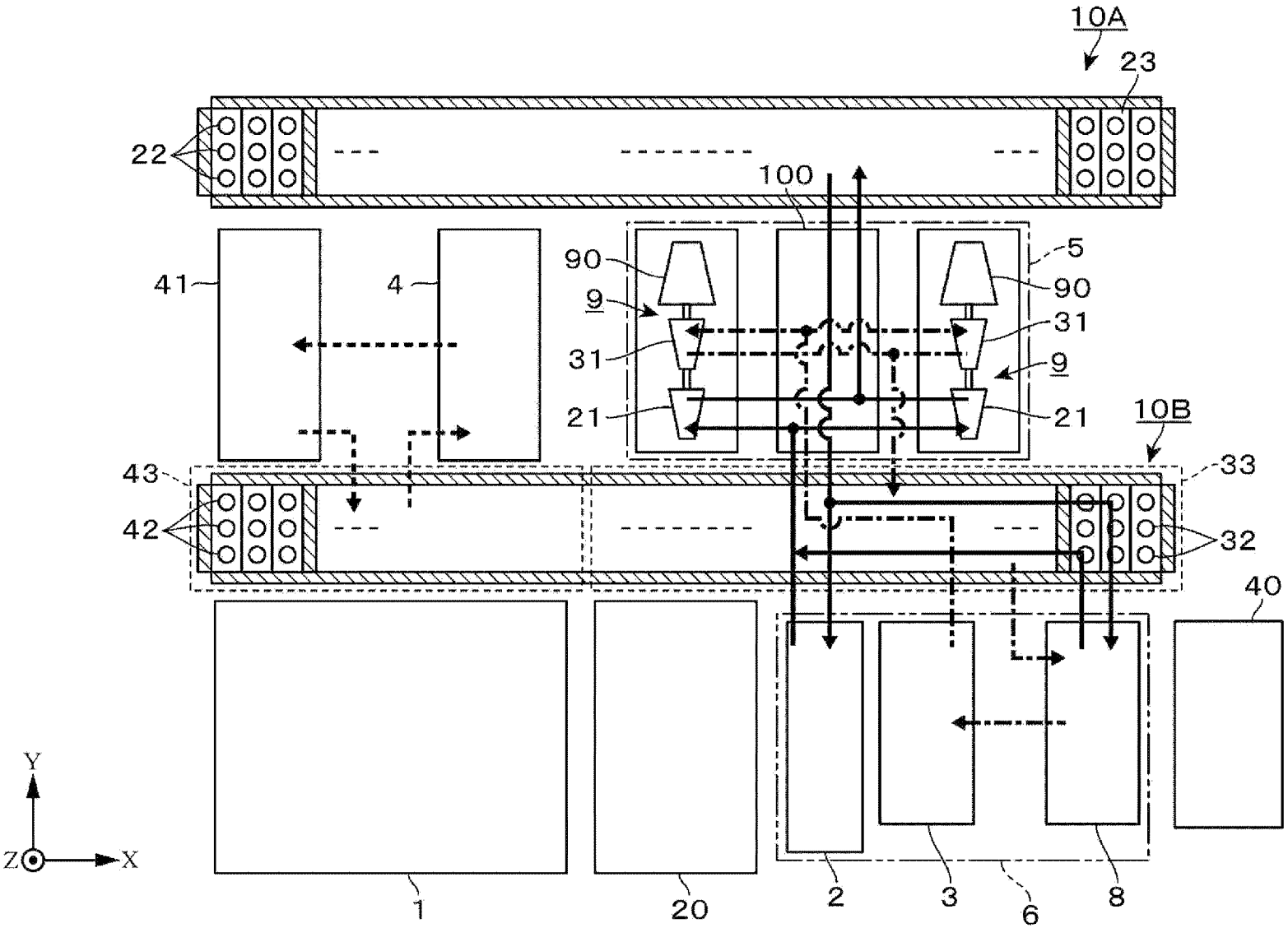
FIG. 2 is a plan view for illustrating flow paths of refrigerants in the NG liquefying apparatus.

Further, in FIG. 2, schematic flow paths of the refrigerants in the NG liquefying apparatus are indicated by the arrows. The solid arrows indicate a flow of the precooling refrigerant. The dot-dash line arrows indicate a flow of the liquefying refrigerant. The broken line arrows indicate a flow of the subcooling refrigerant. In the following, also in FIG. 4 to FIG. 6, the schematic flow paths of the refrigerants are illustrated in the same manner.

The precooling refrigerant to be used in the precooling unit 2 is supplied to the precooling heat exchanger (not shown) of the precooling unit 2 and the heat exchanger for refrigerant cooling 8 so as to be used for precooling of the NG and cooling of the liquefying refrigerant. The precooling refrigerant is vaporized through heat exchange in the precooling heat exchanger of the precooling unit 2 and the heat exchanger for refrigerant cooling 8, and then is supplied to the two first compressors 21 in parallel. After the vaporized precooling refrigerant is compressed by the first compressors 21, the vaporized precooling refrigerant is supplied to the first pipe rack 10A through the auxiliary pipe rack 100, and is cooled, liquefied, and subcooled by the first refrigerant cooler group 22. Moreover, the cooled precooling refrigerant is supplied to the precooling heat exchanger of the precooling unit 2 and the heat exchanger for refrigerant cooling 8 across the second pipe rack 10B through the auxiliary pipe rack 100.

The liquefying refrigerant to be used in the liquefaction unit 3 is vaporized through heat exchange in a cryogenic heat exchanger (not shown) being the heat exchanger for liquefaction of the liquefaction unit 3, and then is supplied to the two second compressors 31 in parallel. The liquefying refrigerant increased in pressure by the second compressors 31 is supplied to the second pipe rack 10B, and is cooled and liquefied by the second refrigerant cooler group 32. The liquefying refrigerant cooled by the second refrigerant cooler group 32 is further cooled by the heat exchanger for refrigerant cooling 8, and is supplied to the cryogenic heat exchanger.

The subcooling refrigerant to be used in the subcooling unit 4 is vaporized through heat exchange in the subcooling heat exchanger of the subcooling unit 4, and then is supplied to the third compressor 41. After the subcooling refrigerant increased in pressure by the third compressor 41 is supplied to the second pipe rack 10B, the subcooling refrigerant is cooled and liquefied by the third refrigerant cooler group 42, and is supplied to the subcooling heat exchanger.

Figure 7:
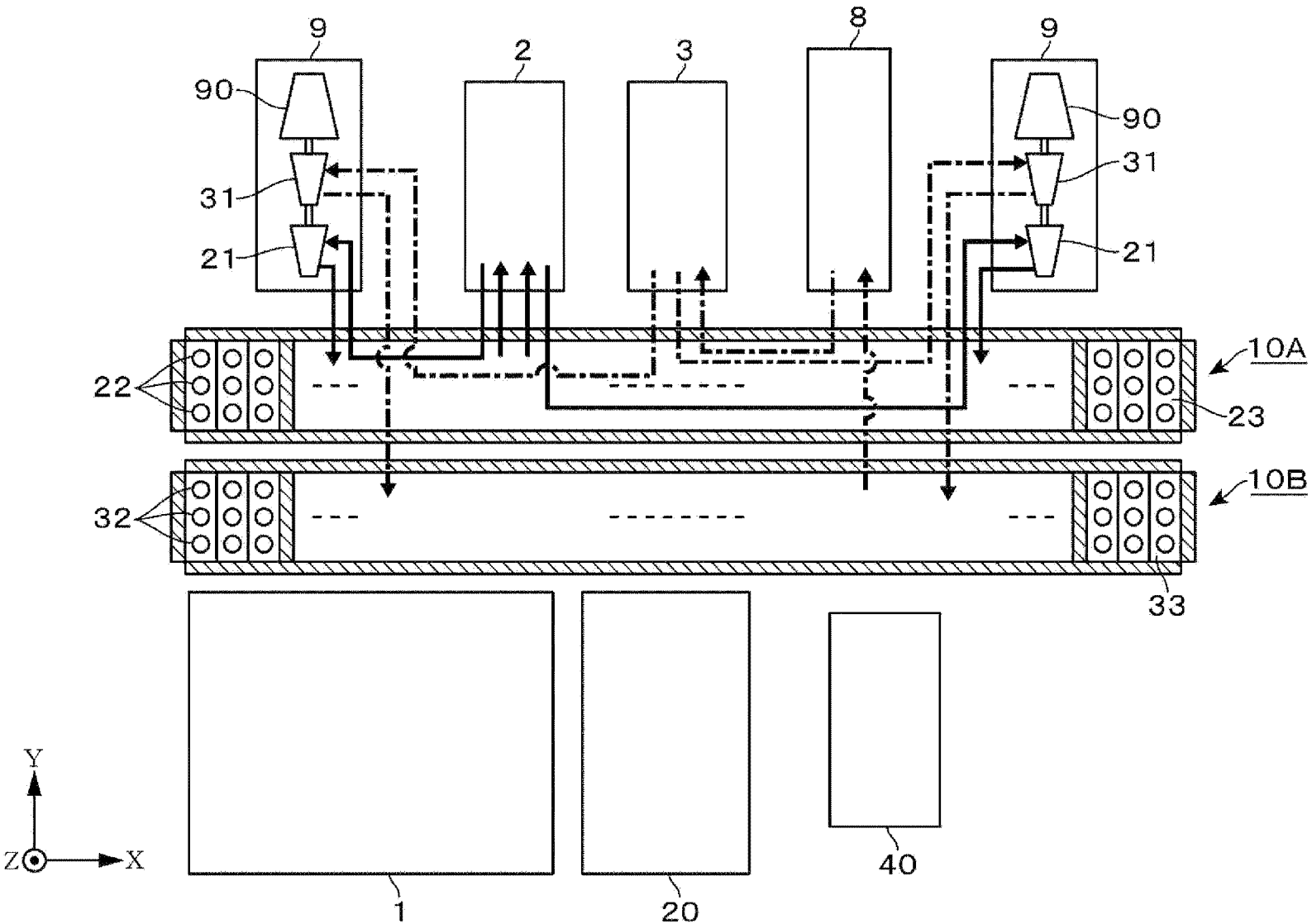
FIG. 7 is a plan view for illustrating an overall configuration of an NG liquefying apparatus in a comparative example.

Effects of the NG liquefying apparatus according to the above-mentioned embodiment are described in comparison with an arrangement example of an NG liquefying apparatus in a comparative example illustrated in FIG. 7. In the NG liquefying apparatus in the comparative example, at a center of the NG liquefying apparatus, the first pipe rack 10A including the first refrigerant cooler group arrangement region 23 and the second pipe rack 10B including the second refrigerant cooler group arrangement region 33 are provided side by side so that long sides of the first pipe rack 10A and the second pipe rack 10B are oriented in the same direction. Along one long side of a side-by-side arrangement region including the first pipe rack 10A and the second pipe rack 10B, the hot section 1, the heavy-component removing unit 20, and the end flash unit 40 are provided in the stated order. Further, along another long side of the side-by-side arrangement region including the first pipe rack 10A and the second pipe rack 10B, the gas turbine compressor 9, the precooling unit 2, the liquefaction unit 3, the heat exchanger for refrigerant cooling 8, and the gas turbine compressor 9 are provided in the stated order.

As in a case of the NG liquefying apparatus in the comparative example described above, in a case in which the two pipe racks 10A and 10B are provided side by side, a distance between the two pipe racks 10A and 10B is reduced. Accordingly, when there is performed work such as installation of a pipe between the two pipe racks 10A and 10B, an entry of a crane between the pipe racks 10A and 10B cannot be allowed. As a result, it is sometimes inevitable to perform work through use of a large-sized crane while the large-sized crane is caused to traverse the pipe racks 10A and 10B from a side of the side-by-side arrangement region including the two pipe racks 10A and 10B.

In view of the problem descried above, in the NG liquefying apparatus according to this embodiment, the compression region 5 is provided between the first pipe rack 10A and the second pipe rack 10B, and the pipe racks 10A and 10B are arranged apart from each other. Accordingly, a sufficient space can be secured for performing work while allowing an entry of, for example, a crane, thereby being capable of achieving easiness of construction work and excellent constructability.

Further, in general, in order to construct the NG liquefying apparatus, devices are sequentially installed from a center of a site for the NG liquefying apparatus to a peripheral edge of the site. Accordingly, in the NG liquefying apparatus in the comparative example illustrated in FIG. 7, first, the two pipe racks 10A and 10B to be arranged at a center of a site are installed, and then devices of the units to be arranged at a peripheral region of the site are installed.

In contrast, in the NG liquefying apparatus according to this embodiment, only the second pipe rack 10B is arranged at the center of the NG liquefying apparatus. Accordingly, installation of one pipe rack 10B involves less work as compared to a case of installing the two pipe racks 10A and 10B. As a result, installation of peripheral devices can be started in a relatively short period of time after installation of the second pipe rack 10B.

Further, as the schematic flows of the refrigerants are described with reference to FIG. 2, in the NG liquefying apparatus according to this embodiment, in the first pipe rack 10A, a treatment using the liquefying refrigerant or the subcooling refrigerant (cooling by the first refrigerant cooler group 22) is not performed. That is, the first pipe rack 10A (first refrigerant cooler group arrangement region) that does not have a direct relation with the liquefying refrigerant and the subcooling refrigerant is provided at a position apart from the flow paths of the refrigerants. Accordingly, pipes through which the refrigerants flow are not installed and traversed in the first pipe rack 10A. Further, as illustrated in FIG. 1, the first pipe rack 10A is also provided at a position apart from a treatment path of the NG, and hence pipes through which the NG is allowed to flow are not installed in the first pipe rack 10A. With the above-mentioned structure, the number of pipes to be arranged in the first pipe rack 10A is reduced. Accordingly, a height of the first pipe rack 10A can be reduced as compared to the comparative example described above. As a result, amounts of components of the first pipe rack 10A to be used can be reduced, and an amount of construction work can be reduced.

When pipe racks having different heights are installed, there is a fear in that the high-temperature air discharged from ACHEs arranged on the lower pipe rack is taken in from a lower surface side of ACHEs arranged on the higher pipe rack, thereby causing hot air recirculation (HAR) that degrades cooling performance of the ACHEs. Accordingly, there may be taken countermeasures to make heights of the air outlet ports of the ACHEs uniform between the pipe racks having different heights by, for example, increasing heights of ducts of the ACHEs arranged on the lower pipe rack.

Moreover, in the NG liquefying apparatus according to this embodiment, the number of pipes to be arranged in the first pipe rack 10A is reduced. As a result, the first pipe rack 10A is well-ventilated, and the ACHEs can easily take in the air, thereby stabilizing an amount of the air taken in by the ACHEs. Accordingly, cooling efficiency of the refrigerant cooler group 22 including the ACHEs is stabilized.

Further, in the NG liquefying apparatus in the comparative example, the two pipe racks 10A and 10B arranged side by side, and a large-diameter pipe through which the vaporized precooling refrigerant or liquefying refrigerant flows are arranged in a non-crossing manner. In this manner, increase in heights of the pipe racks 10A and 10B is suppressed. As a result, for example, as illustrated in FIG. 7, the compressors 21 and 31, the precooling unit 2, and the liquefaction unit 3 are arranged apart from each other in a longitudinal direction of the pipe racks 10A and 10B. In this case, as illustrated in FIG. 7, flowing lengths of the refrigerants and pipe lengths are increased, and hence amounts of materials and the amount of construction work are increased.

In particular, pipes connecting the compressors 21 and the precooling unit 2 and connecting the compressors 31 and the liquefaction unit 3 to each other have large diameters. When lengths of such pipes are increased, amounts of pipe materials and the amount of construction work are significantly increased.

In contrast, in the NG liquefying apparatus according to this embodiment, the compression region 5, in which the first compressors 21 and the second compressors 31 are arranged, and the cooling region 6, in which the precooling unit 2 and the liquefaction unit 3 are arranged, are arranged so as to be opposed to each other across the long side of the second pipe rack 10B (second refrigerant cooler group arrangement region 33). Accordingly, the compressors 21 and 31, the precooling unit 2, and the liquefaction unit 3 are arranged close to each other, and the lengths of the pipes can be reduced, thereby being capable of suppressing increase in amounts of materials and in amount of construction work.

Here, as described above, in the NG liquefying apparatus in the comparative example illustrated in FIG. 7, through selection of the device arrangement in which the large-diameter pipe and the pipe racks 10A and 10B are arranged in a non-crossing manner, increase in heights of the pipe racks 10A and 10B is suppressed.

In contrast, as illustrated in FIG. 2, in the NG liquefying apparatus according to this embodiment in which at least a part of the compression region 5 and at least a part of the cooling region 6 are arranged so as to be opposed to each other across the long side of the second pipe rack 10B, for example, the large-diameter pipe through which the vaporized refrigerant flows is arranged to cross the second pipe rack 10B.

Figure 3:
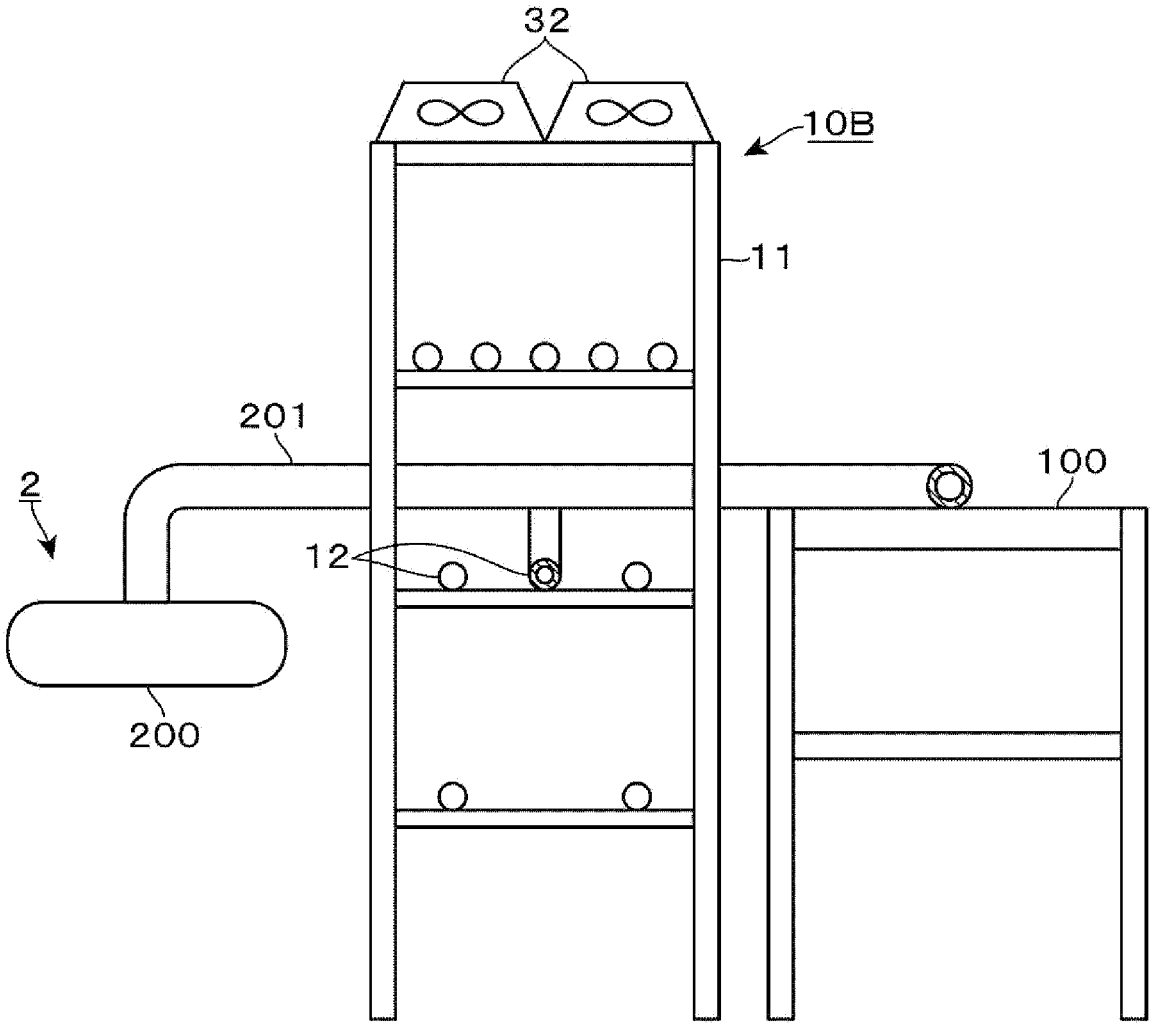
FIG. 3 is an explanatory view for illustrating pipes connecting a cooling region and a compression region to each other.

As countermeasures against this, the inventors propose the following. As illustrated in FIG. 3, for example, a pipe 201 having the largest diameter, which extends from a heat exchanger 200 on the precooling unit 2 side so as to cross the second pipe rack 10B in a direction of a short side of the second pipe rack 10B, is formed into a substantially straight pipe shape. With this configuration, as in the comparative example in which the pipe 201 is arranged in a non-traversing manner, the height of the pipe rack can be reduced.

Meanwhile, when a large-diameter pipe is arranged in a bent manner so as to avoid interference between the large-diameter pipe and another pipe, amounts of materials to be used are increased, and the height of the pipe rack is increased, with the result that construction is complicated. The pipe 201 in the present invention has a substantially straight pipe shape, and hence does not cause such a problem.

According to the NG liquefying apparatus according to this embodiment having the features described above, the following calculation result was obtained. Specifically, a total pipe length can be reduced by about 9% as compared to a configuration in which the units illustrated in FIG. 1 are arranged in the same manner as that in the NG liquefying apparatus in the comparative example (configuration in which, in the comparative example illustrated in FIG. 7, the hot section 1 is arranged in the same manner as that in FIG. 1, the same subcooling unit 4, the same third compressor 41, and the same third refrigerant cooler group 42 as those in FIG. 1 are provided, and the NG is liquefied through use of three kinds of refrigerants).

Figure 4:
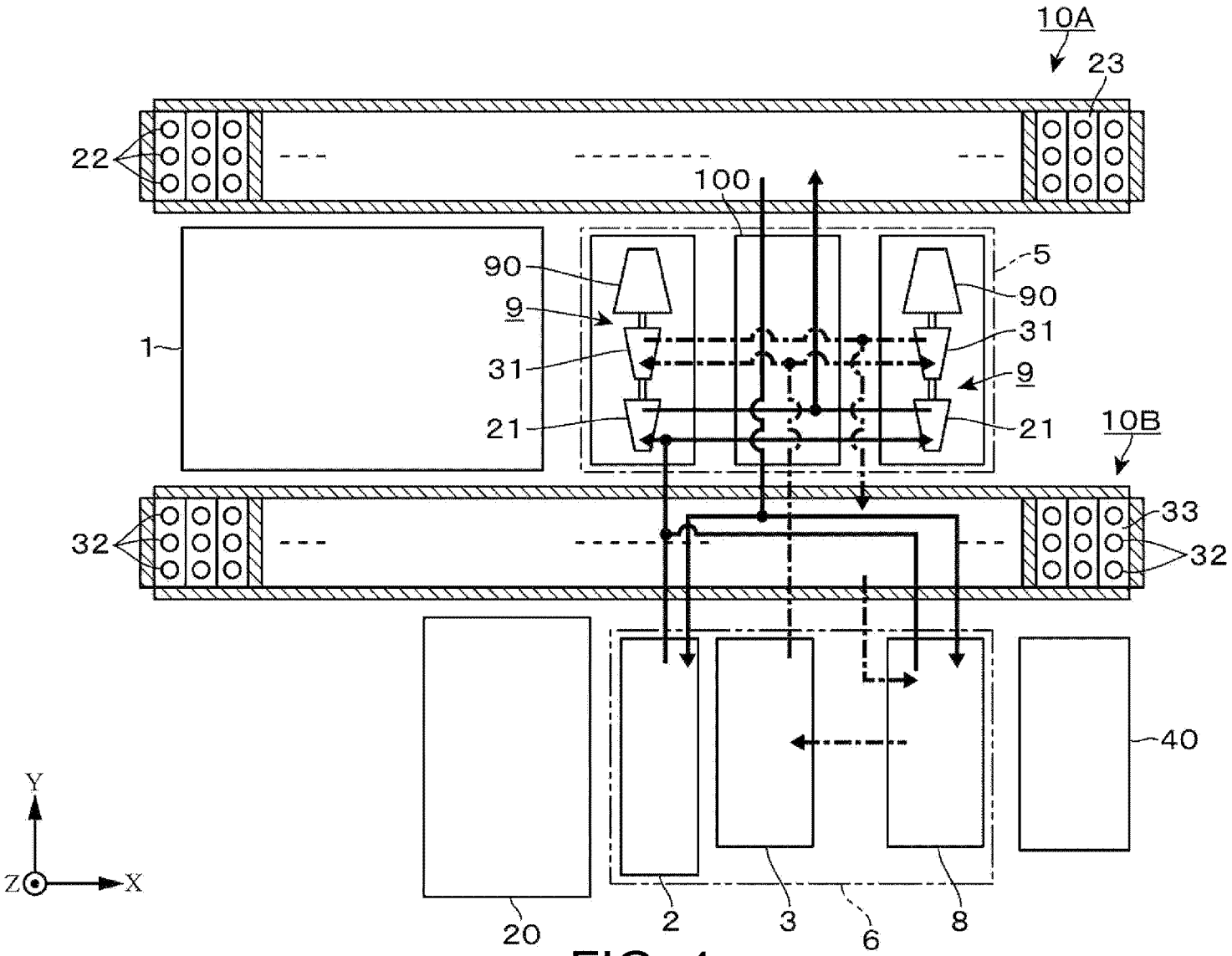
FIG. 4 is a plan view for illustrating another example of the NG liquefying apparatus.

Here, the subcooling unit 4 may be omitted from the NG liquefying apparatus according to this embodiment. FIG. 4 is an illustration of such an NG liquefying apparatus. The NG liquefying apparatus illustrated in FIG. 4 is different from the NG liquefying apparatus illustrated in FIG. 1 in that the third compressor 41 and the subcooling unit 4 are not provided, and that the hot section 1 is provided in a region in which the third compressor 41 and the subcooling unit 4 are provided in the NG liquefying apparatus illustrated in FIG. 1.

Also in this example, (1) the first refrigerant cooler group arrangement region 23 and the second refrigerant cooler group arrangement region 33 are arranged apart from each other, and (2) at least a part of the compression region 5 and at least a part of the cooling region 6 are provided so as to be opposed to each other across the long side of the second pipe rack 10B. With this configuration, the same effects as those of the above-mentioned embodiment can be obtained.

Figure 5:
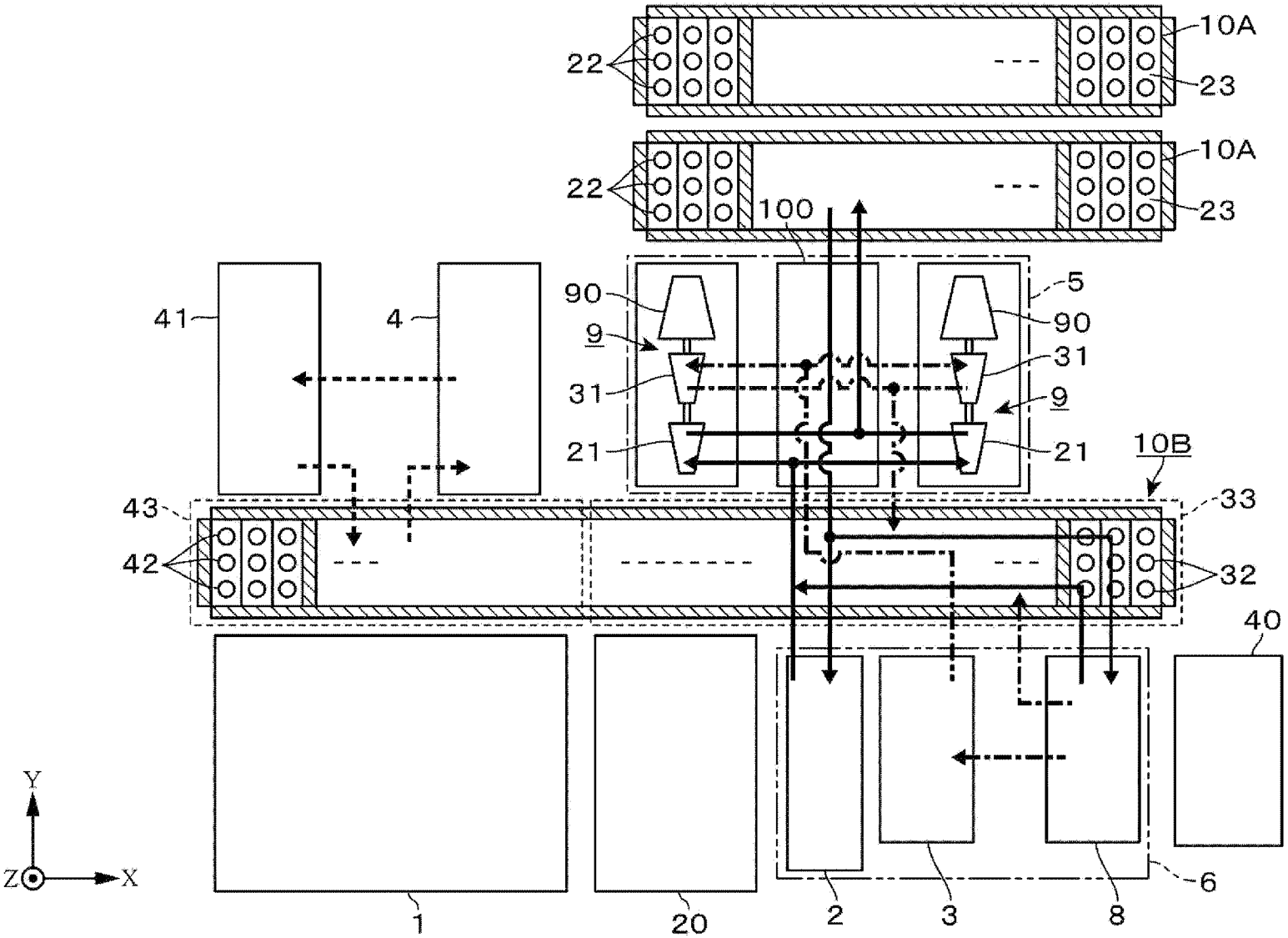
FIG. 5 is a plan view for illustrating still another example of the NG liquefying apparatus.

Further, as illustrated in FIG. 5, the first refrigerant cooler group arrangement region 23 may be divided into regions, and the divided regions may be respectively provided in the two first pipe racks 10A that are arrayed and arranged so as to have rectangular shapes in top view. Long sides of the first refrigerant cooler group arrangement regions 23 may be oriented in the same direction, and the first refrigerant cooler group arrangement regions 23 may be arranged adjacent to each other in a direction of a short side of the first refrigerant cooler group arrangement regions 23.

Figure 6:
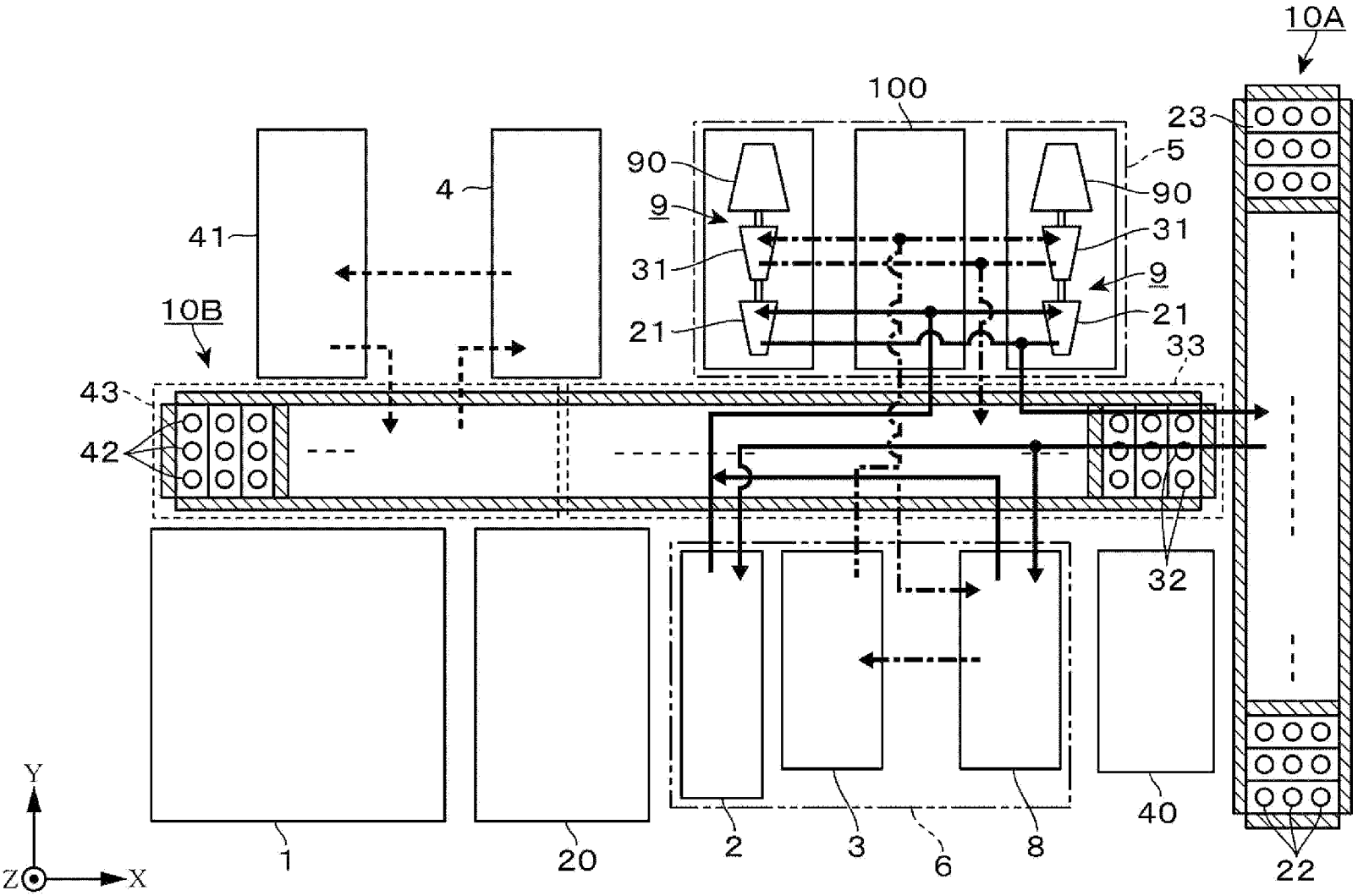
FIG. 6 is a plan view for illustrating still another example of the NG liquefying apparatus.

Moreover, in the NG liquefying apparatus according to this embodiment, it is only required that the first refrigerant cooler group arrangement region 23 be arranged so that a long side of the first refrigerant cooler group arrangement region 23 is opposed to one side of a rectangular region including the compression region 5, the one side being different from a side of the rectangular region opposed to a long side of the second refrigerant cooler group arrangement region 33. For example, as illustrated in FIG. 6, the first refrigerant cooler group arrangement region 23 and the second refrigerant cooler group arrangement region 33 may be arranged so that a long side of the refrigerant cooler group arrangement region 23 and a long side of the refrigerant cooler group arrangement region 33 sandwich the same one corner of the rectangular region including the compression region 5 (lower right corner of the rectangular region illustrated in FIG. 6).

What is claimed is:

1. A natural gas liquefying apparatus for liquefying natural gas, comprising:

a cooling region in which a precooling unit and a liquefaction unit are arranged, the precooling unit including a precooling heat exchanger configured to precool, through use of a precooling refrigerant, the natural gas supplied to the natural gas liquefying apparatus, the liquefaction unit including a heat exchanger for liquefaction configured to liquefy the precooled natural gas through use of a liquefying refrigerant;

a compression region in which a first compressor and a second compressor are arranged, the first compressor being configured to compress the precooling refrigerant vaporized by the precooling heat exchanger, the second compressor being configured to compress the liquefying refrigerant vaporized by the heat exchanger for liquefaction;

a first refrigerant cooler group arrangement region in which an air-cooled cooler group configured to cool the precooling refrigerant compressed by the first compressor is arrayed and arranged so as to have a rectangular shape having a long side and a short side in top view; and a second refrigerant cooler group arrangement region in which an air-cooled cooler group configured to cool the liquefying refrigerant compressed by the second compressor is arrayed and arranged so as to have a rectangular shape having a long side and a short side in top view, wherein at least a part of the cooling region and at least a part of the compression region are arranged so as to be opposed to each other across the long side of the rectangular shape of the second refrigerant cooler group arrangement region, and wherein the first refrigerant cooler group arrangement region is arranged so that the long side of the first refrigerant cooler group arrangement region is opposed to one side of a rectangular region including the compression region, the one side being different from a side of the rectangular region opposed to the long side of the second refrigerant cooler group arrangement region.

2. The natural gas liquefying apparatus according to claim 1, wherein the first refrigerant cooler group arrangement region and the second refrigerant cooler group arrangement region are arranged so as to be opposed to each other across the rectangular region.

3. The natural gas liquefying apparatus according to claim 1, wherein the first refrigerant cooler group arrangement region and the second refrigerant cooler group arrangement region are arranged so that a long side of the first refrigerant cooler group arrangement region and a long side of the second refrigerant cooler group arrangement region are respectively opposed to two sides of the rectangular region that sandwich a same one corner of the rectangular region.

4. The natural gas liquefying apparatus according to claim 1, wherein a subcooling unit and a third compressor are arranged, the subcooling unit including a subcooling heat exchanger configured to subcool the liquefied natural gas through use of a subcooling refrigerant, the third compressor being configured to compress the subcooling refrigerant vaporized by the subcooling heat exchanger.

5. The natural gas liquefying apparatus according to claim 1, wherein the first refrigerant cooler group arrangement region is divided into two refrigerant cooler group arrangement regions arrayed and arranged so as to have rectangular shapes in top view, and wherein long sides of the two refrigerant cooler group arrangement regions are oriented in a same direction, and the two refrigerant cooler group arrangement regions are arranged adjacent to each other in a direction of the short sides of the two refrigerant cooler group arrangement regions.

6. The natural gas liquefying apparatus according to claim 1, wherein the first compressor and the second compressor are configured to be driven by a shared driver.

* * * * *